US008191496B2

(12) United States Patent
Fishman

(10) Patent No.: US 8,191,496 B2
(45) Date of Patent: Jun. 5, 2012

(54) PUMP HORN

(76) Inventor: Michael Fishman, Ft Lauderdale, FL (US)

( * ) Notice: Subject to any disclaimer, the term of this patent is extended or adjusted under 35 U.S.C. 154(b) by 157 days.

(21) Appl. No.: 12/720,313

(22) Filed: Mar. 9, 2010

(65) Prior Publication Data

US 2011/0220004 A1 Sep. 15, 2011

(51) Int. Cl.
*G10K 9/04* (2006.01)
*F04B 33/00* (2006.01)

(52) U.S. Cl. ..... 116/142 FP; 417/544

(58) Field of Classification Search ..... 116/137 R, 116/139, 142 FP, 142 FV, 142 R; 417/542, 417/544; 446/188, 192, 193; 92/17, 24
See application file for complete search history.

(56) References Cited

U.S. PATENT DOCUMENTS

| | | | | | |
|---|---|---|---|---|---|
| 209,200 | A * | 10/1878 | Tarr | 116/139 |
| 235,509 | A * | 12/1880 | Chester | 116/139 |
| 436,651 | A * | 9/1890 | Dyer | 116/139 |
| 816,430 | A * | 3/1906 | Cairns | 116/139 |
| 987,772 | A * | 3/1911 | Swan et al. | 116/139 |
| 1,272,822 | A * | 7/1918 | Lund | 116/139 |
| 1,663,648 | A * | 3/1928 | Cooper | 116/142 FP |
| 3,397,620 | A * | 8/1968 | Skelton et al. | 92/24 |
| 4,252,077 | A * | 2/1981 | Frigo | 116/142 FP |
| 4,524,676 | A * | 6/1985 | Rogers | 91/43 |
| 4,635,536 | A * | 1/1987 | Liu et al. | 92/24 |
| 5,022,341 | A * | 6/1991 | Eveanowsky et al. | 116/142 FP |
| 5,415,153 | A * | 5/1995 | Johnson et al. | 124/63 |
| 5,620,314 | A * | 4/1997 | Worton | 417/550 |
| 5,782,198 | A * | 7/1998 | Sinclair et al. | 116/139 |
| 6,250,205 | B1 * | 6/2001 | Chuang | 92/15 |
| 6,299,420 | B1 * | 10/2001 | Saputo et al. | 417/527 |
| 6,497,560 | B2 * | 12/2002 | Carlson | 417/553 |
| 6,817,060 | B2 * | 11/2004 | Huang et al. | 16/111.1 |
| 6,890,162 | B2 * | 5/2005 | Ding | 417/572 |
| 7,389,740 | B2 * | 6/2008 | Wishinsky | 116/142 FP |
| 7,451,688 | B2 * | 11/2008 | Takahashi et al. | 92/17 |
| 2006/0150890 | A1 * | 7/2006 | Cohen | 116/142 FP |

FOREIGN PATENT DOCUMENTS

| | | | |
|---|---|---|---|
| CN | 201812484 U | * | 4/2011 |
| DE | 4304996 A1 | * | 8/1994 |
| WO | WO 2007051376 A1 | * | 5/2007 |

* cited by examiner

*Primary Examiner* — Richard A Smith

(57) ABSTRACT

The pump horn includes a chamber that can be filled continuously and indefinitely by a push/pull slide that when pushed into the chamber forces pressurized air through an attachable member, a tube, a sound producing device, and an amplifying unit to produce a loud blast sound. The push/pull slide includes a screw in piece at the end which is secureable to the attachable member within the chamber for releasable securement of the push/pull slide. This allows compact carrying and storage.

18 Claims, 7 Drawing Sheets

PUMP HORN

BACKGROUND

This relates to pump horn specifically to the ease of use, environmentally safe and reusable indefinitely manual powered air horn unit. The invention consists of a chamber that can be filled continuously and indefinitely by a push/pull slide attached to a suction piece that exerts pressurized air pushed through a smaller tube creating a higher pressure that goes through the sounding unit and finally through the horn sound producing device making a loud sound.

Traditional air horns have used aerosols to make the sound blasts. However, the old style air horn aerosols have certain disadvantages. First the aerosol air horns are aerosols and put greenhouse gases into the atmosphere. Second after the gas is used up the gas needs to be discarded which is a waste of resources and money.

Our pump horn which is manually operated has the first advantage of never needing greenhouse gases to operate. The second advantage of our pump horn is it can work indefinitely without needing to purchase refill cans in order to operate. This advantage is very important because the user is assured of proper operation of the unit if needed in an emergency and no risk of the unit not having available gas to operate.

SUMMARY OF INVENTION

A pump of the pump horn, a handle attached to the push/pull slide by a screw on nut or glued on securely or molded in plastic to fit on securely. The push/pull slide is made of steel, aluminum or plastic made to be able to slide in and out of the pump and serves as the force to push the air into a horn which eventually makes the pump horn make its sound. The chamber is made of steel, aluminum, hard plastic or some durable material with holes at both ends to compress air and push out the air at a higher pressure. In this embodiment of the invention the chamber is a circular solid tube about 2¼ inches in diameter steel with a small hole at one end which the attachable member is placed where the horn can be attached. This is only one embodiment of the invention and the chamber can be made to any shape or size. The other end there is a top holed cap has a steel lip with four ridges so the top holed cap can be slid and locked on. The other end of the chamber there is a compressible member or spring that can be made of steel, plastic or any material with a slight spring that assist in helping the suction piece go back for the next blow of the horn. The suction piece made of plastic, metal or rubber with an indent to put on the "O" ring which can be a material such as rubber or plastic to help form the seal and push air toward the horn at a pressure. In this embodiment the seal formed by the "O" ring does have some air permeable characteristics but it is preferable to have a tighter seal. The top holed cap can be made of plastic, rubber or metal and in this embodiment of the invention is attached and immovable to the chamber. The push/pull slide moves within the chamber causing the air to be forced out of the attachable member hole. The hole is where the air comes out of the attachable member. The attachable member in this embodiment is a steel threaded screw on piece on the outside of the chamber and threaded in the inside part. The holder is configured with the attachable member by nut that screws on the outside of chamber to hold the attachable member in place. There are many variations that the attachable member can be attached to the chamber, including but not limited to being molded directly into the chamber.

A horn of the pump horn can have an overcap configured to cover the sound producing device. The amplifying unit will be conical and made of plastic or metal and configured to amplify the sound made by the amplifying unit. The tube will be configured to allow air at a pressure from the chamber to pass through it into the sound producing device. The tube in this embodiment is made of plastic and threaded so that it can be screwed and unscrewed onto the attachable member wherein the horn is connected to the chamber. The embodiment of this invention has tube that is threaded but is not limited to just being connected by threaded pieces to the pump but can include any male/female connection.

The sound producing device will have an overcap. In this preferred embodiment of the invention the sound producing device cap is made of metal and circular and configured to allow a diaphragm to fit into it. The sound producing device cap in this preferred embodiment is made of metal and crimped onto the plastic horn. The diaphragm is a thin plastic circular sheet less than ¼ mm thick. The tube goes from the pump to the sound producing device emptying air into the sound producing device at small hole. The big hole then sends out the sound from the sound producing device through big hole. This sound is then amplified by the amplifying unit.

The push/pull slide according to this preferred embodiment has a suction piece attached to the push/pull slide. The push/pull slide is a metal rod in this embodiment of this invention but can be made of any material that is suitable for providing force to push the suction piece in the scope of this invention. In this embodiment of the invention the end of the push/pull slide wherein a suction piece is attached by a hole and threaded allowing a nut to hold the suction piece in place. In this embodiment of the invention the push/pull slide will be tapered to a smaller threaded part that can be screwed into the inside part of the attachable member. An "O" ring that fits into the suction piece will assist in building the higher pressure in the chamber. The suction piece will have an indentation for the "O" ring to hold it on the suction piece. The push/pull slide can be extended and inserted into the chamber to produce the pressure that will go to the horn through the tube and the sound producing device causing the diaphragm to vibrate and the horn to produce sound through the amplifying device.

Operation

The operation uses a push/pull slide attached to a suction piece that when pushed into the chamber exerts pressurized air that is then pushed into smaller tube creating a higher pressure that goes through the sound producing device and finally through the amplifying unit making a loud sound. The sound is made because a large amount of air is pushed through a tube and the air vibrates against the tube to make sound. A plastic diaphragm inside the horn oscillates between its open and closed position as the air passes through. The vibration is carried to and magnified by a sound amplifying unit which vibrates at the same frequency. Because the entire horn vibrates that transfer of vibrations to the air makes a loud sound. The push/pull slide then is sprung back by a compressible member, i.e., a spring, located in front of the chamber assisting the push/pull slide to be back in position for the next horn blasts.

BRIEF DESCRIPTION OF THE DRAWINGS

FIG. 4*a* shows a perspective view of how the suction piece is kept in position by way of a nut. Additionally it shows whereby the push pull horn screws into the inside part of the attachable member.

FIG. 4*b* shows the "O" ring that fits around the suction piece.

FIG. 4*c* shows a cross sectional view of the suction piece according to a preferred embodiment.

DETAILED DESCRIPTION

Figure 1:
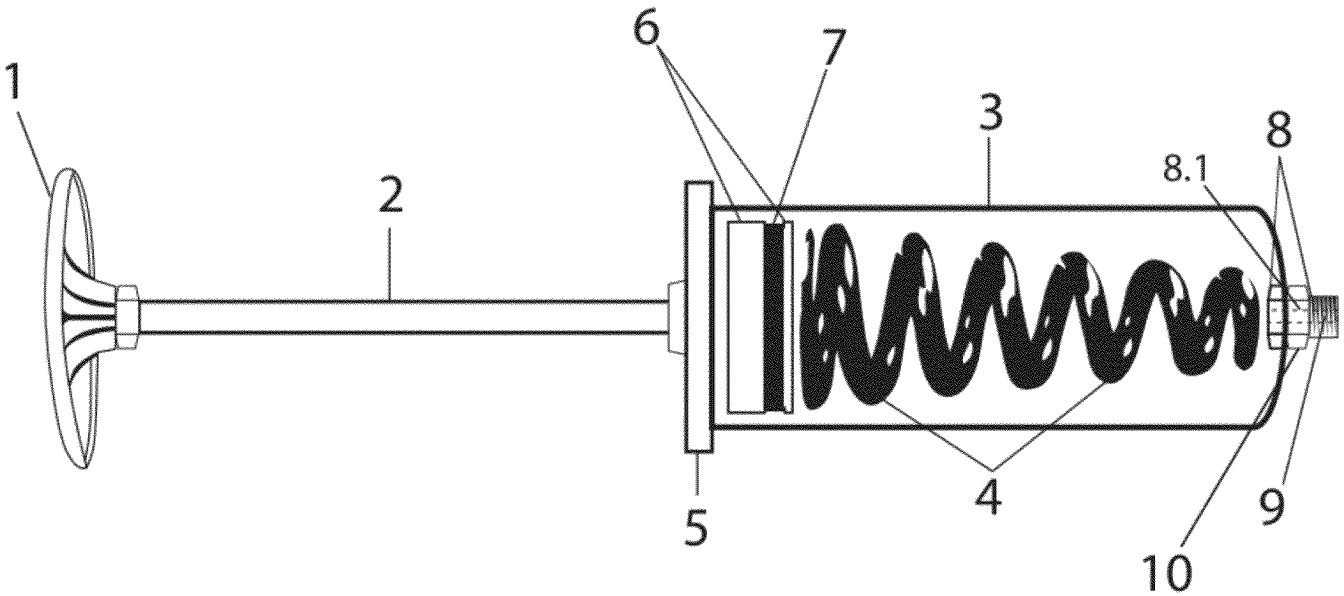
FIG. 1 shows a perspective view of just the pump according to a preferred embodiment.

Referring now to FIG. 1, is a pump of the pump horn, the handle 1 of the FIG. 1 pump in the preferred embodiment is circular, square rectangular and or ergonomically shaped molded plastic, metal, aluminum or rubber. Referring to the handle 1 is attached to the push/pull slide 2 by a screw on nut or glued on securely or molded in plastic to fit on securely. The push/pull slide 2 is made of steel, aluminum or plastic made to be able to slide in and out of the pump and serves as the force to push the air into a horn FIG. 2 which eventually makes the pump horn make its sound. The chamber 3 is made of steel, aluminum, hard plastic or some durable material with holes at both ends to compress air and push out the air at a higher pressure. In this embodiment of the invention the chamber 3 is a circular solid tubular structure about 2¼ inches in diameter steel with a small hole at one end which the attachable member 8 is placed where the horn can be attached. In this embodiment of the invention the attachable member 8 is threaded in the inside which is attachable member inner part 8.1. This is only one embodiment of the invention and the chamber can be made to any shape or size as long as there is a pressured air exit. The other end of the chamber has a steel lip with four ridges so the top holed cap 5 can be slid and locked on onto the chamber 3. The other end is a compressible member 4 can be made of steel, plastic or any material with a slight spring that assist in helping the suction piece 6 go back for the next blow of the horn. The suction piece 6 made of plastic, metal or rubber with an indent to put on the "O" ring 7 which can be a material such as rubber or plastic to help form the seal and push air toward the horn at a pressure. In this embodiment the seal formed by the "O" ring 7 does have some air permeable characteristics but it is preferable to have a tighter seal. The top holed cap can be made of plastic, rubber or metal and in this embodiment of the invention is attached and immovable to the chamber 3. The push/pull slide 2 moves in and out of the chamber 3 causing the air to be forced out of the attachable member 8. The hole 9 is where the air comes out of the attachable member 8. The attachable member 8 in this embodiment is a steel threaded screw on piece which is attachably mounted on the chamber 3 and includes a threaded inner part 8.1 adjacent the hole 9. However the attachable member 8 can be made of plastic or any other material. The holder 10 is configured with the attachable member 8 by nut that screws on the outside of chamber 3 to hold the attachable member 8 in place. There are many variations that the attachable member 8 can be attached to the chamber 3, including but not limited to being molded directly into the chamber 3.

Figure 2:
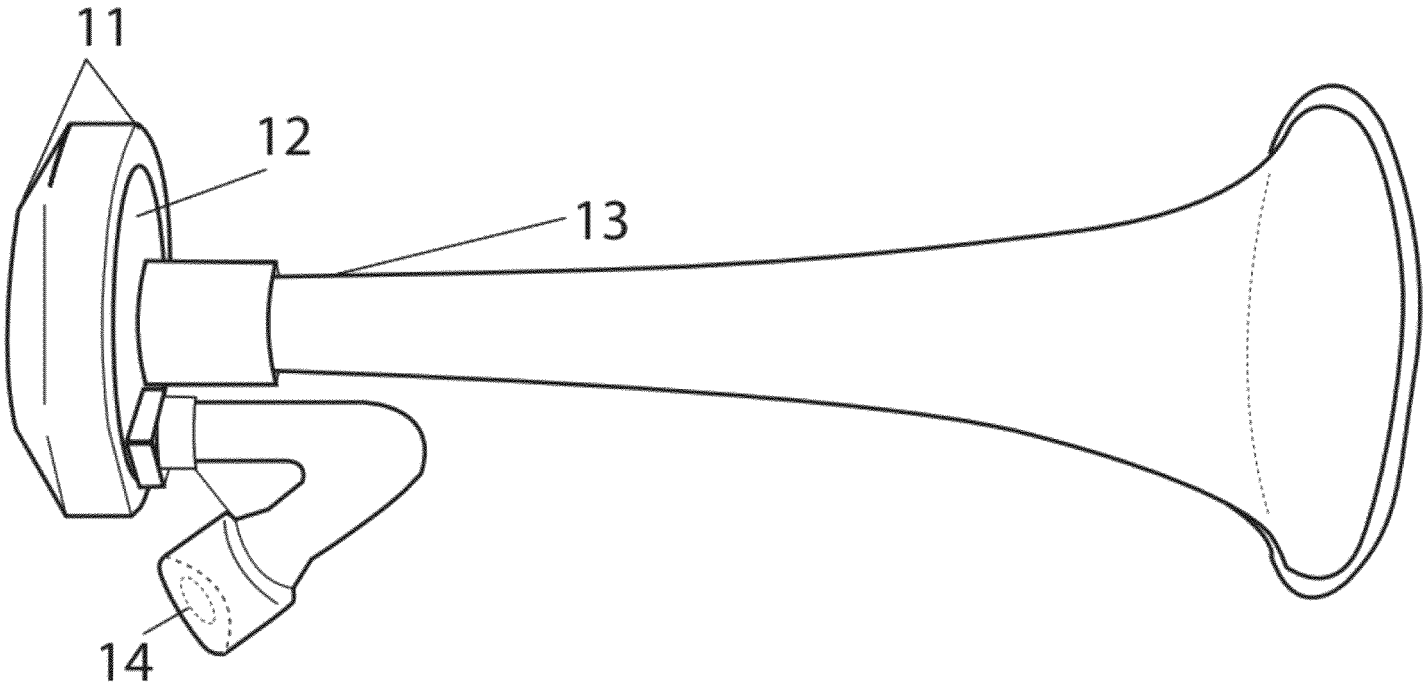
FIG. 2 shows a perspective view of just the horn according to a preferred embodiment.

FIG. 2 is a horn of the pump horn which will have an overcap 11 to configured cover the sound producing device 12. An amplifying unit 13 will be conical and made of plastic or metal and configured to amplify the sound made by a diaphragm 16 and vibrations of material with pressured air put into it. In this embodiment of the invention the amplifying unit is made of plastic but can be made of metal, fiberglass or any surface that can vibrate and make noise. The tube 14 will be configured to allow air at a pressure from the pump FIG. 1 to pass through it into the sound producing device 12. The tube in this embodiment is made of plastic and threaded so that it can be screwed and unscrewed onto the attachable member 8 whereby the horn is connected to the pump. FIGS. 11, 12, 13 and 14 are all made of plastic in this embodiment but can be made of metal, acrylic or any hard surface. The embodiment of this invention has tube 14 that is threaded but is not limited to just being connected by threaded pieces to the pump but can include any male/female connection.

Figures 3, 3A, 3B:
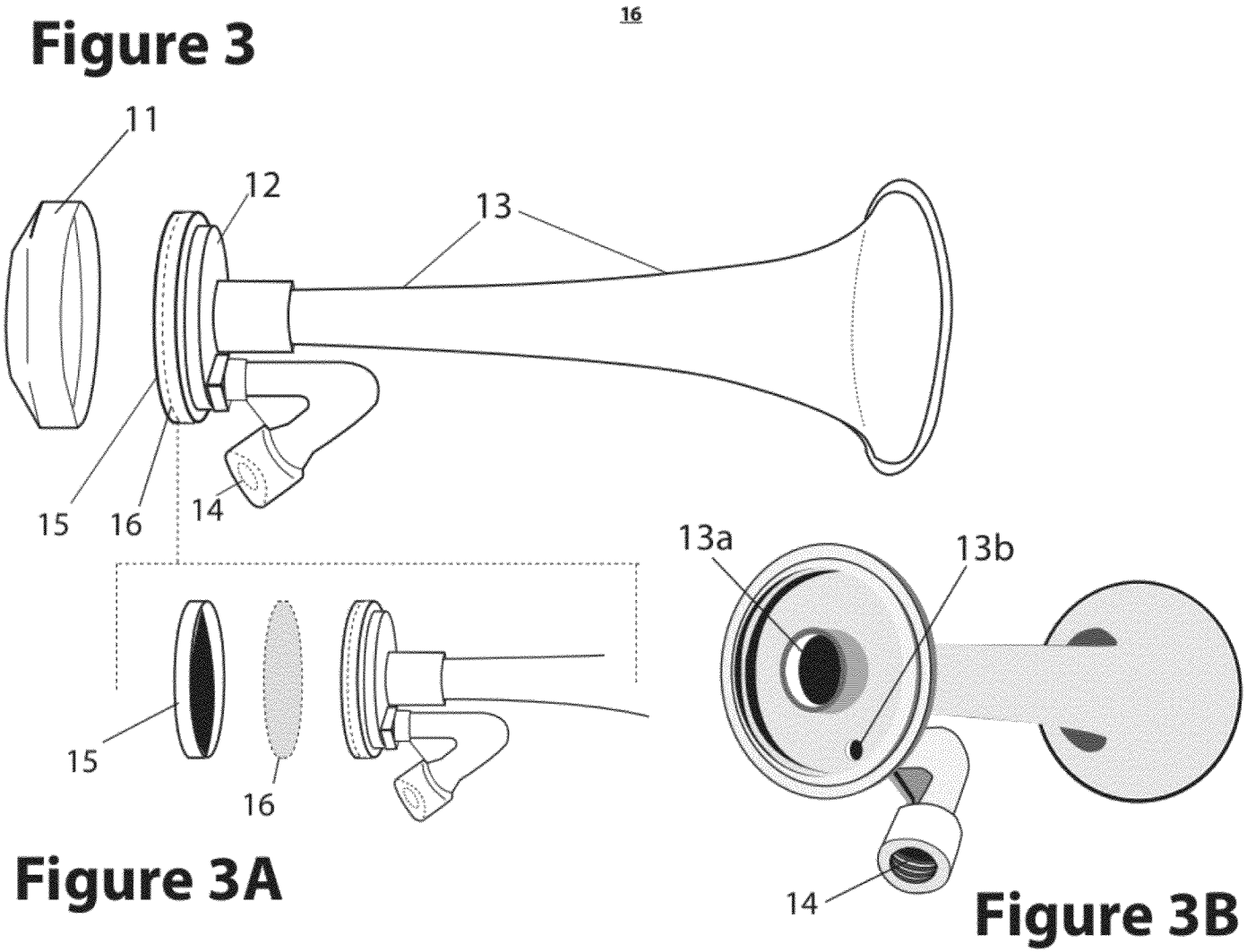
FIG. 3 shows a perspective view of just the horn taken apart according to a preferred embodiment.
FIG. 3*a* shows a cross sectional view of the sound producing device shown in FIG. 3.
FIG. 3*b* shows an inside view of the tube and small hole going to the sound producing device and big hole going to the amplifying unit.

FIG. 3 is a horn and shows the overcap 11 off the sound producing device 12. FIG. 3*a* shows a cross sectional view of the sound producing device shown in FIG. 3. In this preferred embodiment of the invention the sound producing device cap 15 is made of metal and circular and configured to allow a diaphragm 16 to fit into it. The sound producing device cap 15 in this embodiment is crimped onto the plastic horn. A diaphragm 16 is a thin plastic circular sheet less than ¼ mm thick. FIG. 3*b* shows an inside view of the tube and holes of the sound producing device 12. The tube 14 goes from the pump to the sound producing device 12 emptying air into the sound producing device 12 at small hole 13*b*. The big hole 13*a* then sends out the pressurized air and vibrations that produce sound from the sound producing device 12 through big hole 13*a*. This sound is then amplified by the amplifying unit 13.

Figure 4:
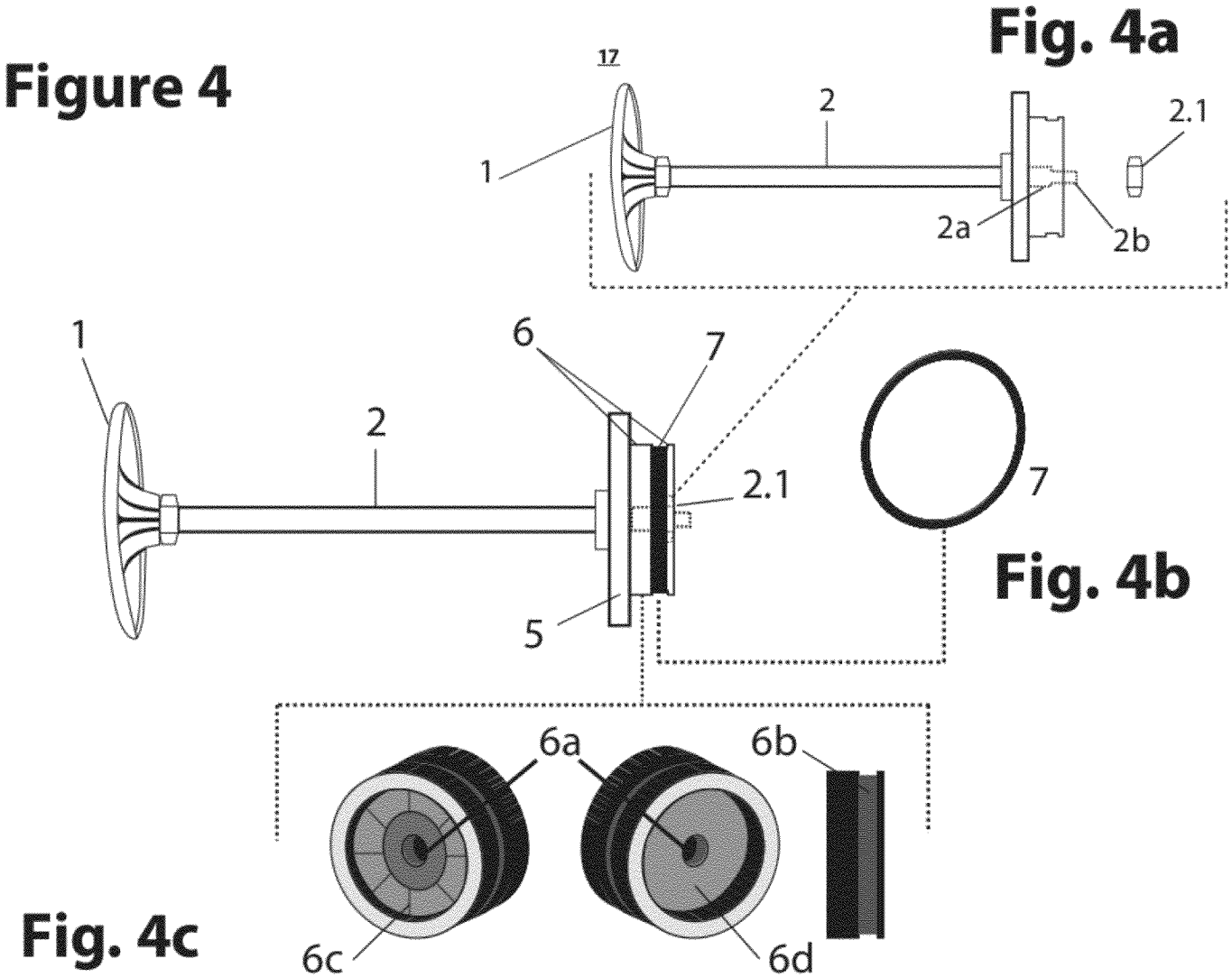
FIG. 4 shows a perspective view of the push/pull slide according to a preferred embodiment.

FIG. 4 shows a perspective view of the push/pull slide 2. According to a preferred embodiment FIG. 4*a* shows how the suction piece 6 is attached to the push/pull slide 2. The push/pull slide 2 is a metal rod in this embodiment of this invention but can be made of any material that is suitable for providing force to push the suction piece 6. In this embodiment of the invention the end of the push/pull slide 2 where the suction piece 6 is attached by a metal threaded piece 2*a* allowing a nut 2.1 to be tightened over threaded piece 2*a* to hold the suction piece 6 in place. In this embodiment of the invention the push/pull slide 2 will be tapered to a smaller threaded part 2*b* that will screw into the threaded inner part 8.1 that is inside the chamber 3. FIG. 4*b* shows a perspective view of the "O" ring that fits into the suction piece 6. FIG. 4*c* shows the suction piece 6 and the suction piece hole 6*a*. The suction piece hole 6*a* fits into the threaded piece 2*a* as seen in FIG. 4*a* so that the suction piece 6 is held on to the push/pull slide 2. In this embodiment of the invention the suction piece 6 has an indented piece 6*b* that the "O" ring 7 fits into to hold it on the suction piece 6. FIG. 4*c* shows a perspective view of the suction piece 6 with an indented inner part 6*d* which pushes air out with pressure from the chamber 3. FIG. 4*c* shows a perspective view of the suction piece 6 that has reinforced plastic outer part 6*c*. The suction piece 6 can be made of plastic metal or rubber or any material that can be pushed with force to create pressure.

Figure 5:
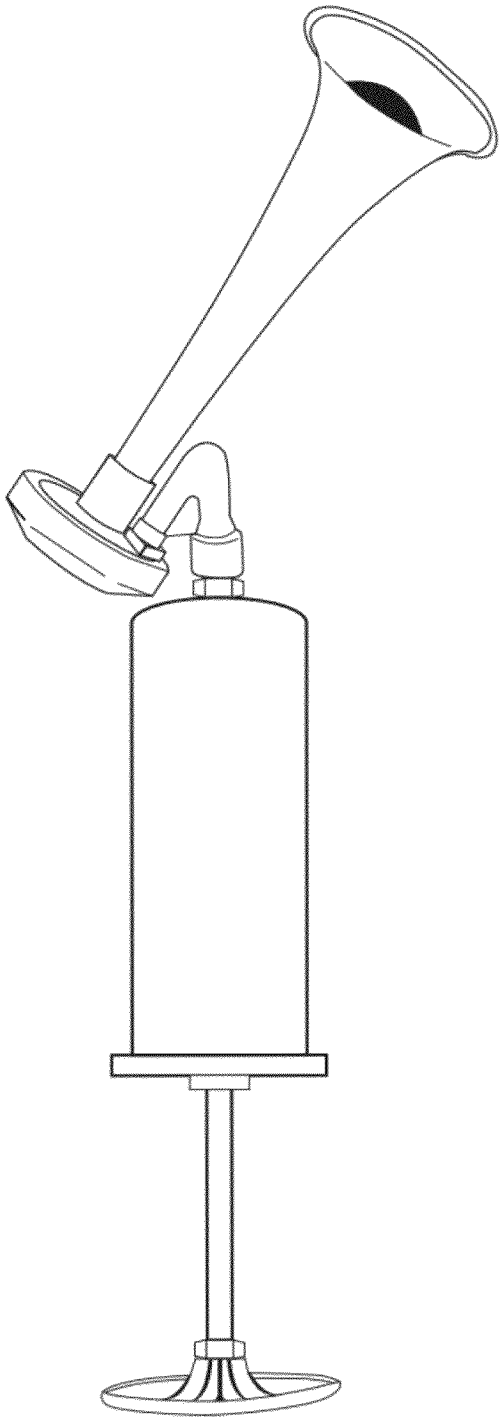
FIG. 5 is a perspective view that shows the pump horn put together that is with both the horn connected to the pump and the push/pull slide 2 fully extended according to a preferred embodiment. It is the pump horn before it lets out sound.

FIG. 5 is a perspective view that shows the pump horn put together that is with both the horn connected to the pump and the push/pull slide 2 fully extended according to a preferred embodiment of this invention. This perspective also shows the horn before sound is emitted.

Figure 6:
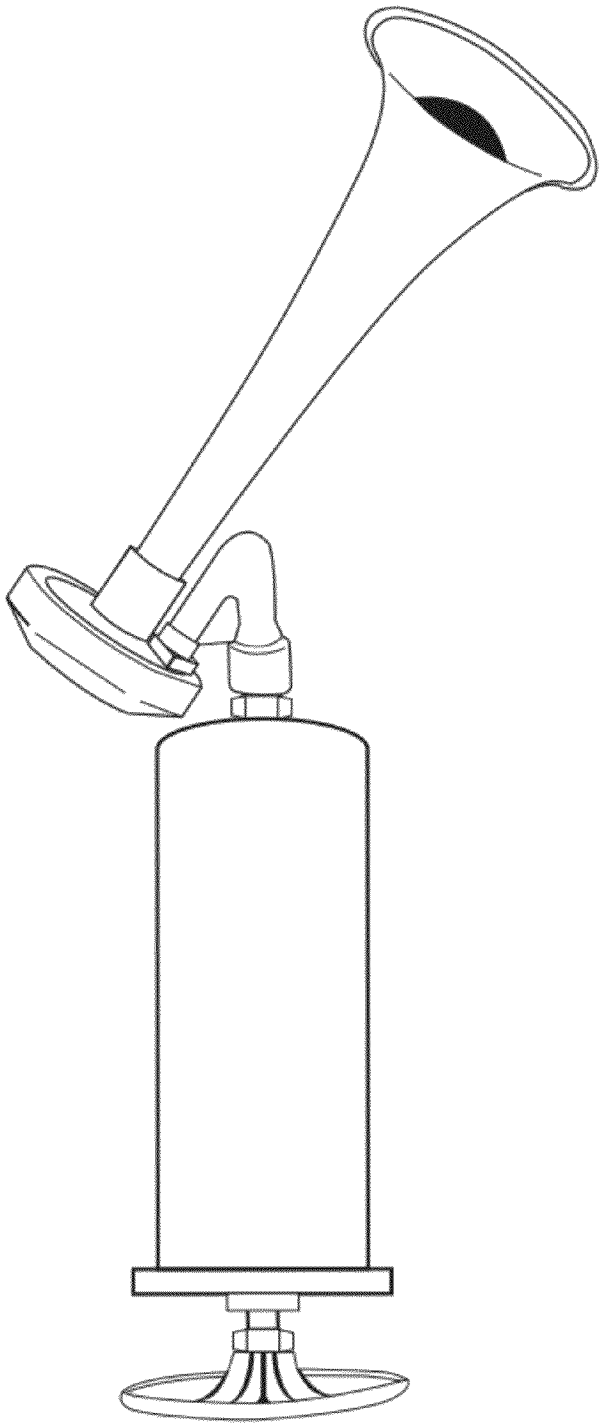
FIG. 6 is a perspective view that shows the pump horn put together that is with the pump and the horn however in this embodiment the push/pull slide 2 is pushed in. This is the position of the push pull slide 2 after the pump horn lets out its horn sound.

FIG. 6 is a perspective view that shows the pump horn put together that is with the pump and the horn however in this embodiment the push/pull slide 2 is pushed in. FIG. 6 can also be embodiment of the pump horn after the horn sounds. FIG. 6 can also be a perspective view of when the push/pull slide 2 is threaded in as in FIG. 7 but with the pump and horn connected.

Figure 7:
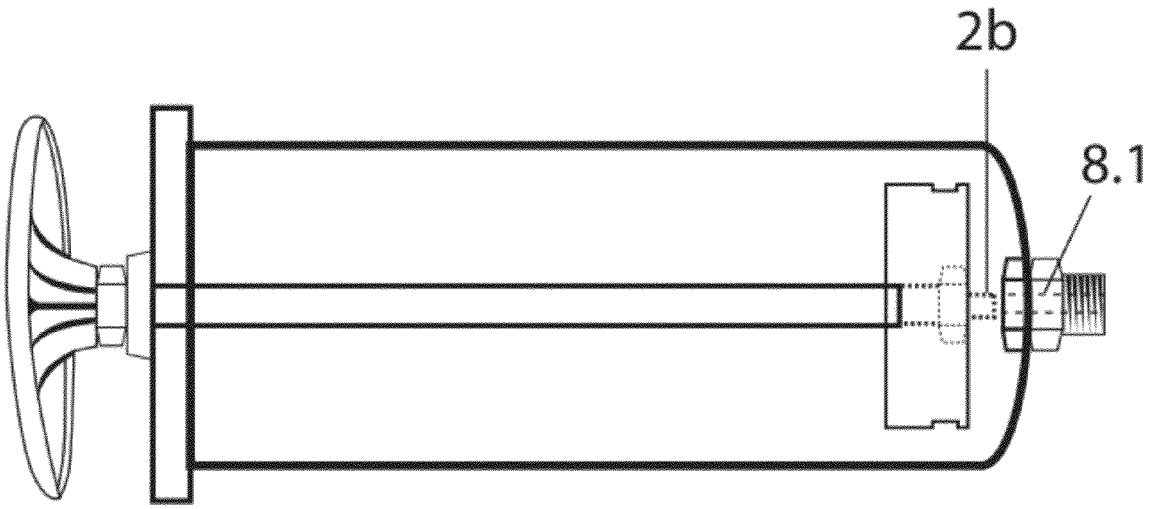
FIG. 7 is a perspective view that shows the push/pull slide of the small threaded part 2*b* screwed into the into attachable member inner part 8.1 for compact carrying of the pump horn.

FIG. 7 is a perspective of the push/pull slide 2 with smaller threaded part 2*b* threaded into the threaded inner part 8.1. This threaded inner part 8.1 of the attachable member 8 allows securement of the push/pull slide 2 for compact carrying and storage. The securement is accomplished by the push/pull slide 2 being pushed inward and rotated so that the threads on the smaller threaded part 2*b* are secured to the threaded inner part 8.1. Upon intended usage the push/pull slide 2 is reversibly rotated to release the push/pull slide 2 so that the pump may perform its air pumping function.

The invention claimed is:

1. A pump horn comprising:

(a) a pump having a chamber, an attachable member, a push/pull slide, and a top holed cap wherein:

the chamber has the attachable member at one end and the top holed cap at the other end, the attachable member protrudes from the chamber and includes a hole therein for passage of high pressure air out of the chamber, the other end of the chamber is open ended so that the push/pull slide can be inserted into and out of the chamber, the push/pull slide comprises a suction piece that can slide within the chamber creating air pressure so that the high pressure air will flow through the hole, the top holed cap is connected to the chamber for supporting the push/pull slide for sliding movement within the chamber, a handle is on one end of the push/pull slide to allow the user to operate the push/pull slide, the push/pull slide includes a screw in piece, and the attachable member is configured for releasable securing the screw in piece so that the push/pull slide is releasably secured for compact carrying of the pump horn; and (b) an attachable horn having a tube, a sound producing device, and an amplifying unit wherein:

the tube connects the attachable member and the sound producing device for conducting the high pressure air from the pump to the sound producing device, the sound producing device includes a diaphragm that oscillates from the high pressure air, and the amplifying unit amplifies the sound produced by the sound producing device.

2. The pump horn as said in claim 1 wherein the chamber will be cylindrical and made of steel, aluminum, tin, hard plastic or other durable material.

3. The pump horn as said in claim 1 including a holder made of plastic that will attach on both sides of the chamber to hold the attachable member in place.

4. The pump horn as said in claim 1, wherein the other end of the chamber includes a lip and ridges so the top holed cap can be attached, the top holed cap and the ridges on the chamber will be aligned to make a secure fit.

5. The pump horn as said in claim 1 wherein the pump is manually operated by pulling and pushing the push/pull slide, so that when the push/pull slide is pushed then air is forced through the tube.

6. The pump horn as said in claim 1 wherein the handle for the push/pull slide is round and ergonomic to the user for ease of use.

7. The pump horn as said in claim 1 wherein the chamber will contain a compressible member or steel spring to help reposition the suction piece for the next blow of the horn.

8. The pump horn as said in claim 1 wherein the chamber will have a lip at the open end to easily be connected to the top holed cap so the push/pull slide can be inserted and removed from the chamber.

9. The pump horn as said in claim 1 wherein the suction piece is made of a circular plastic piece that is indented in the middle for positioning of an "O" ring so to create an air tight barrier inside the chamber.

10. The pump horn as said in claim 1 wherein the push/pull slide has a steel thread at the end opposite the handle, a nut threaded upon the steel thread to attach the suction piece.

11. The pump horn as said in claim 1 wherein the suction piece will have oil or grease lubrication on it to help it slide within the chamber.

12. The pump horn as said in claim 1 wherein the tube will be plastic and "V" shaped that goes to the sound producing device for best management of the pressurized air.

13. The pump horn as said in claim 1, wherein the sound producing device is a piece of aluminum in a circular shaped clipped onto plastic with a plastic diaphragm that when air passes through it at a high speed makes vibrations to make the horn sound.

14. The pump horn as said in claim 1, wherein the attachable horn includes a plastic overcap to cover it for both protection and aesthetic look.

15. The pump horn as said in claim 1, wherein the amplifying unit is made of hard plastic and is conical in shape as to best amplify the horn sound.

16. The pump horn as said in claim 1, wherein the attachable horn will be able to be screwed on and screwed off of the pump for compact carrying of the attachable horn and pump as separate pieces.

17. The pump horn as said in claim 1 wherein the pump and horn can be one piece together.

18. A pump horn comprising:

(a) a pump having a chamber, an attachable member, a push/pull slide, and a top holed cap wherein:

the chamber has the attachable member at one end and the top holed cap at the other end, the attachable member protrudes from the chamber and includes a hole therein for passage of high pressure air out of the chamber, the other end of the chamber is open ended so that the push/pull slide can be inserted into and out of the chamber, the push/pull slide comprises a suction piece that can slide within the chamber creating air pressure so that the high pressure air will flow through the hole, the top holed cap is connected to the chamber for supporting the push/pull slide for sliding movement within the chamber, a handle is on one end of the push/pull slide to allow the user to operate the push/pull slide, the push/pull slide includes a screw in piece, the attachable member includes a threaded inner part about the hole, the threaded inner part being configured for releasable securing the screw in piece so that the push/pull slide is releasably secured for compact carrying of the pump horn; and (b) an attachable horn having a tube, a sound producing device, and an amplifying unit wherein:

the tube connects the attachable member and the sound producing device for conducting the high pressure air from the pump to the sound producing device, the sound producing device includes a diaphragm that oscillates from the high pressure air, and the amplifying unit amplifies the sound produced by the sound producing device.

* * * * *